US007631875B2

(12) United States Patent
Jones et al.

(10) Patent No.: US 7,631,875 B2
(45) Date of Patent: Dec. 15, 2009

(54) TABLE CARD GAME

(76) Inventors: Richard Franklin Jones, 2116 Lone Tree Dr., Findlay, OH (US) 45840; Yvonne Marie DeMarce, 6902 Edmonton St., Horn Lake, MS (US) 38637

( * ) Notice: Subject to any disclaimer, the term of this patent is extended or adjusted under 35 U.S.C. 154(b) by 0 days.

(21) Appl. No.: 12/133,453

(22) Filed: Jun. 5, 2008

(65) Prior Publication Data

US 2008/0303216 A1 Dec. 11, 2008

Related U.S. Application Data

(60) Provisional application No. 60/930,707, filed on Jun. 5, 2007.

(51) Int. Cl.
*A63F 1/00* (2006.01)

(52) U.S. Cl. ..... 273/292; 463/12

(58) Field of Classification Search ..... 273/292, 273/309, 274; 463/12, 13
See application file for complete search history.

(56) References Cited

U.S. PATENT DOCUMENTS 3,666,270 A 5/1972 Mazur
5,374,067 A * 12/1994 Jones ..... 273/292
5,613,682 A * 3/1997 Otuzbiryan ..... 273/292
5,782,473 A * 7/1998 Chou et al. ..... 273/292
5,876,283 A 3/1999 Parra et al.
6,237,916 B1 5/2001 Webb
6,345,823 B1 2/2002 Webb
6,644,666 B1 11/2003 Tamura et al.
6,698,759 B2 3/2004 Webb et al.
6,871,856 B1 3/2005 Rozboril
7,338,362 B1 * 3/2008 Gallagher ..... 463/13
7,562,876 B2 * 7/2009 Sklansky et al. ..... 273/292
2005/0051963 A1 3/2005 Snow
2006/0237906 A1 10/2006 Bowling

* cited by examiner

*Primary Examiner*—Benjamin H Layno
(74) *Attorney, Agent, or Firm*—Fraser Clemens Martin & Miller LLC; J. Douglas Miller

(57) ABSTRACT

A method of playing a table card game is provided. A player makes a first wager as to whether a predetermined number of cards in a hand of cards dealt to the player will add up to a predetermined qualifying value. The player may also optionally make a bonus wager as to whether the predetermined number of cards will be a bonus combination. If the player cannot make the qualifying value the player loses the wagers, otherwise the player is paid according to a pay scale. The player may then optionally make a second chance wager and a second chance bonus wager based on the predetermined number of cards in a hand of community cards dealt. If the qualifying value cannot be made from the community hand, the player loses the wagers, otherwise the player is paid according to a pay scale.

13 Claims, 4 Drawing Sheets

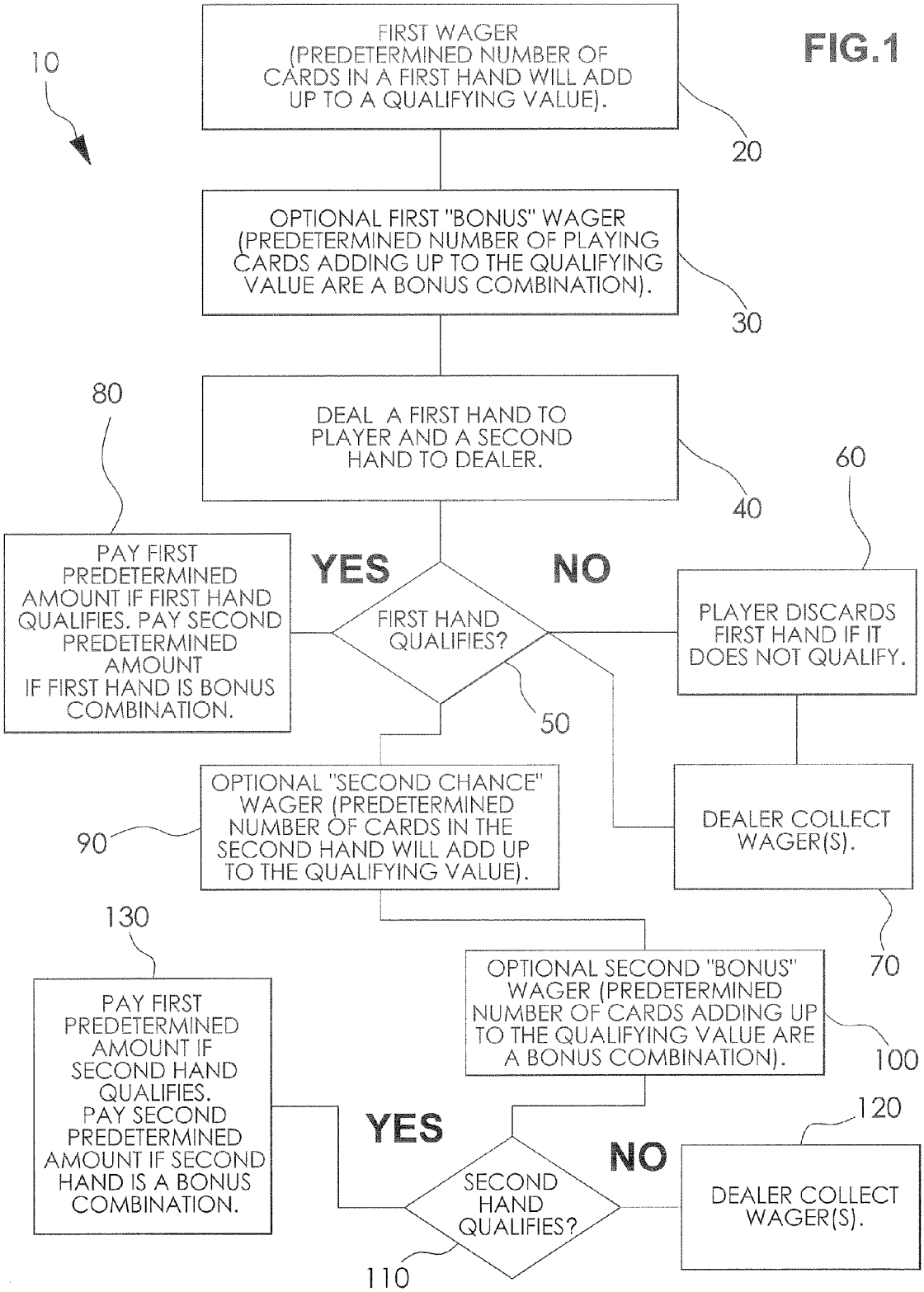
FIG.1
10
FIRST WAGER (PREDETERMINED NUMBER OF CARDS IN A FIRST HAND WILL ADD UP TO A QUALIFYING VALUE).
20
OPTIONAL FIRST "BONUS" WAGER (PREDETERMINED NUMBER OF PLAYING CARDS ADDING UP TO THE QUALIFYING VALUE ARE A BONUS COMBINATION).
30
DEAL A FIRST HAND TO PLAYER AND A SECOND HAND TO DEALER.
40
80
PAY FIRST PREDETERMINED AMOUNT IF FIRST HAND QUALIFIES. PAY SECOND PREDETERMINED AMOUNT IF FIRST HAND IS BONUS COMBINATION.
YES
NO
FIRST HAND QUALIFIES?
50
60
PLAYER DISCARDS FIRST HAND IF IT DOES NOT QUALIFY.
OPTIONAL "SECOND CHANCE" WAGER (PREDETERMINED NUMBER OF CARDS IN THE SECOND HAND WILL ADD UP TO THE QUALIFYING VALUE).
90
DEALER COLLECT WAGER(S).
70
130
OPTIONAL SECOND "BONUS" WAGER (PREDETERMINED NUMBER OF CARDS ADDING UP TO THE QUALIFYING VALUE ARE A BONUS COMBINATION).
100
PAY FIRST PREDETERMINED AMOUNT IF SECOND HAND QUALIFIES. PAY SECOND PREDETERMINED AMOUNT IF SECOND HAND IS A BONUS COMBINATION.
YES
NO
120
SECOND HAND QUALIFIES?
110
DEALER COLLECT WAGER(S).

TABLE CARD GAME

CROSS-REFERENCE TO RELATED APPLICATIONS

This application claims the benefit of U.S. Provisional Application No. 60/930,707, filed on Jun. 5, 2007. The entire disclosure of the above application is hereby incorporated herein by reference.

FIELD OF THE INVENTION

The present disclosure relates to a casino game and more particularly to a table card game using at least one standard deck of cards and involving wagering based on a dealt hand of the cards.

BACKGROUND OF THE INVENTION

There are many wagering games used for gambling. Wagering games are intended to be exciting and arouse a player's interest. Typical wagering games are also uncomplicated and can be understood easily by a large number of players. Ideally, the wagering game should include more than one wagering opportunity during the course of the game, yet be able to be played rapidly to a wager resolving outcome. Exciting play, the opportunity to make more than one wager, and rapid wager resolution enhance a player's interest and enjoyment because the number of betting opportunities and bet resolution is increased.

Wagering games, particularly those intended primarily for play in casinos, also provide a player with a sense of participation and control, the opportunity to make decisions, and reasonable odds of winning, even though the odds generally favor the casino, house, dealer or banker. The wagering game must also meet the requirements of regulatory agencies. A variety of wagering games, including wagering games for casino play, with multiple wagering opportunities are known. Many known wagering games find some basis in the often played card games of poker and blackjack. Typical wagering games may employ a standard fifty-two card deck as is well-known in the art.

There is a continuing need for a wagering game for play in casinos. Desirably, the game is uncomplicated, exciting, and provides the opportunity for a player to make multiple wagers and choices regarding those wagers.

SUMMARY OF THE INVENTION

In concordance with the instant disclosure, a wagering game for play in casinos that is uncomplicated, exciting, and provides the opportunity for a player to make multiple wagers and choices regarding those wagers, is surprisingly discovered.

In one embodiment, a method of playing a table card game using a deck of playing cards includes the steps of: a) allowing a player to make an optional first wager as to whether a predetermined number of cards in a first hand to be dealt to the player from the deck of playing cards will add up to a qualifying value; b) allowing the player to optionally make a first bonus wager as to whether the predetermined number of cards of the first hand dealt to the player that will add up to the qualifying value will also be a predetermined bonus combination; c) dealing the first hand to the player and a second chance hand as a community hand; d) determining whether a predetermined number of cards in the first hand add up to the qualifying value; e) paying the player a first predetermined amount based on the amount of the player's first wager if the predetermined number of cards in the first hand add up to the qualifying value, and paying the player a second predetermined amount based on the amount of the player's optional bonus wager, if any, if the predetermined number of cards that add up to the qualifying value are the predetermined bonus combination; f) collecting the player's first wager if the predetermined number of cards in the first hand do not add up to the qualifying value, and collecting the player's optional first bonus wager, if any, if the predetermined number of cards in the first hand that add up to the qualifying value are not the predetermined bonus combination; g) allowing the player to optionally make a second chance wager as to whether the predetermined number of cards in the second chance hand dealt from the deck of playing cards will add up to the qualifying value; h) allowing the player to optionally make a second chance bonus wager as to whether the predetermined number of cards in the second chance hand that will add up to the qualifying value will also be the predetermined bonus combination; i) determining whether a predetermined number of cards in the second chance hand add up to the qualifying value; j) paying the player the first predetermined amount based on the amount of the player's second chance wager if the predetermined number of cards in the second chance hand add up to the qualifying value, and paying the player the second predetermined amount based on the amount of the player's optional second chance bonus wager, if any, if the predetermined number of cards in the second chance hand that add up to the qualifying value are the predetermined bonus combination; and k) collecting the player's second chance wager and optional second chance bonus wager, if any, if the predetermined number of cards in the second chance hand do not add up to the qualifying value.

In another embodiment, a casino table for playing a table card game includes a tabletop with a substantially planar upper playing surface. The playing surface has a first betting area for placement of a first wager by a player, a second chance betting area for placement of an optional second chance wager by a player, and at least one bonus betting area for placement of an optional bonus wager by a player.

In a further embodiment, a method of playing a table card game using a deck of playing cards includes steps of: a) providing a player and a dealer; b) allowing the player to make a mandatory first wager as to whether three cards in a first hand of four cards to be dealt to the player from the deck of playing cards will add up to a qualifying value of ten (10), twenty (20), or thirty (30); c) allowing the player to optionally make a first bonus wager as to whether three cards of the first hand dealt to the player that will add up to the qualifying value will also be one of a pair, a flush, a straight, a three-of-a-kind, and a straight flush; d) dealing the first hand face down to the player and a second chance hand face down to the dealer; e) allowing the player to examine the first hand; f) allowing the player to discard the first hand if the player determines that three of the cards in the first hand will not add up to the qualifying value of ten (10), twenty (20), or thirty (30); g) collecting the player's first wager and, if any, the optional first bonus wager if the player discards the first hand; h) turning face up the first hand dealt to the player if the player does not discard the first hand; i) determining whether the three remaining cards in the first hand add up to the qualifying value of ten (10), twenty (20), or thirty (30); j) paying the player a first predetermined amount at a 1 to 1 pay scale based on the amount of the player's first wager if the three remaining cards in the first hand add up to the qualifying value of ten (10), twenty (20), or thirty (30); k) paying the player a second predetermined amount at a pay scale as follows i) Pair—2 to 1, ii) Flush—5 to 1, iii) Straight—6 to 1, iv) Three-of-a-kind—30 to 1, v) Straight flush—40 to 1 based on the amount of the player's optional bonus wager, if any, if three of the cards that add up to the qualifying value of ten (10), twenty (20), or thirty (30) are one of the pair, the flush, the straight, the three-of-a-kind, and the straight flush; l) collecting the player's first wager if three of cards in the first hand do not add up to the qualifying value of ten (10), twenty (20), or thirty (30); m) collecting the player's optional first bonus wager, if any, if three of the cards in the first hand that add up to the qualifying value are not one of the pair, the flush, the straight, the three-of-a-kind, and the straight flush; n) allowing the player to optionally make a second chance wager as to whether three of the cards in the second chance hand dealt to the dealer will add up to the qualifying value of ten (10), twenty (20), or thirty (30); o) allowing the player to optionally make a second chance bonus wager as to whether three of the cards in the second chance hand dealt to the dealer that will add up to the qualifying value of ten (10), twenty (20), or thirty (30) will also be one of the pair, the flush, the straight, the three-of-a-kind, and the straight flush; p) turning face up the second chance hand dealt to the dealer; q) determining whether three of the cards in the second chance hand add up to the qualifying value of ten (10), twenty (20), or thirty (30); r) paying the player the first predetermined amount at a 1 to 1 pay scale based on the amount of the player's second chance wager if the predetermined number of cards in the second chance hand add up to the qualifying value; s) paying the player the second predetermined amount at a pay scale as follows i) Pair—2 to 1, ii) Flush—5 to 1, iii) Straight—6 to 1, iv) Three-of-a-kind—30 to 1, v) Straight flush—40 to 1, based on the amount of the player's optional second chance bonus wager, if any, if three of the cards in the second chance hand that add up to the qualifying value are one of the pair, the flush, the straight, the three-of-a-kind, and the straight flush; and t) collecting the player's second chance wager and optional second chance bonus wager, if any, if three of the cards in the second chance hand do not add up to the qualifying value of ten (10), twenty (20), or thirty (30).

DRAWINGS

The above, as well as other advantages of the present disclosure, will become readily apparent to those skilled in the art from the following detailed description, particularly when considered in the light of the drawings described hereafter.

FIG. 1 is a flow diagram depicting a table card game according to the present disclosure;

DETAILED DESCRIPTION OF THE INVENTION

Figure 2:
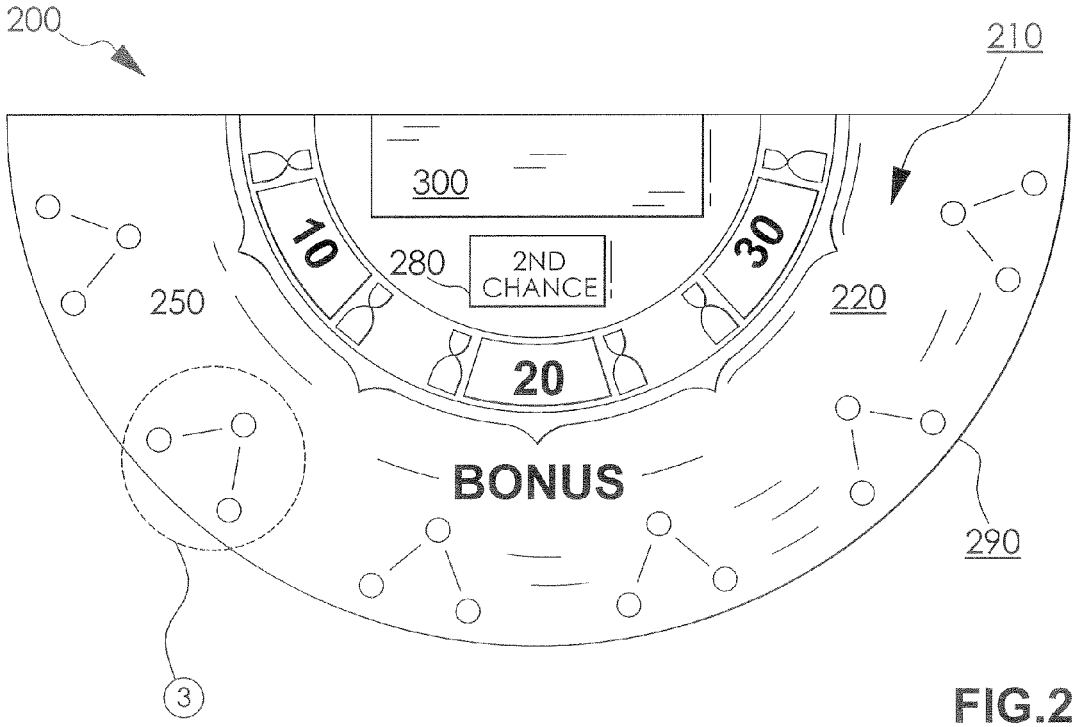
FIG. 2 is a top plan view of a table configured for use with the table card game depicted in FIG. 1.
Figure 3:
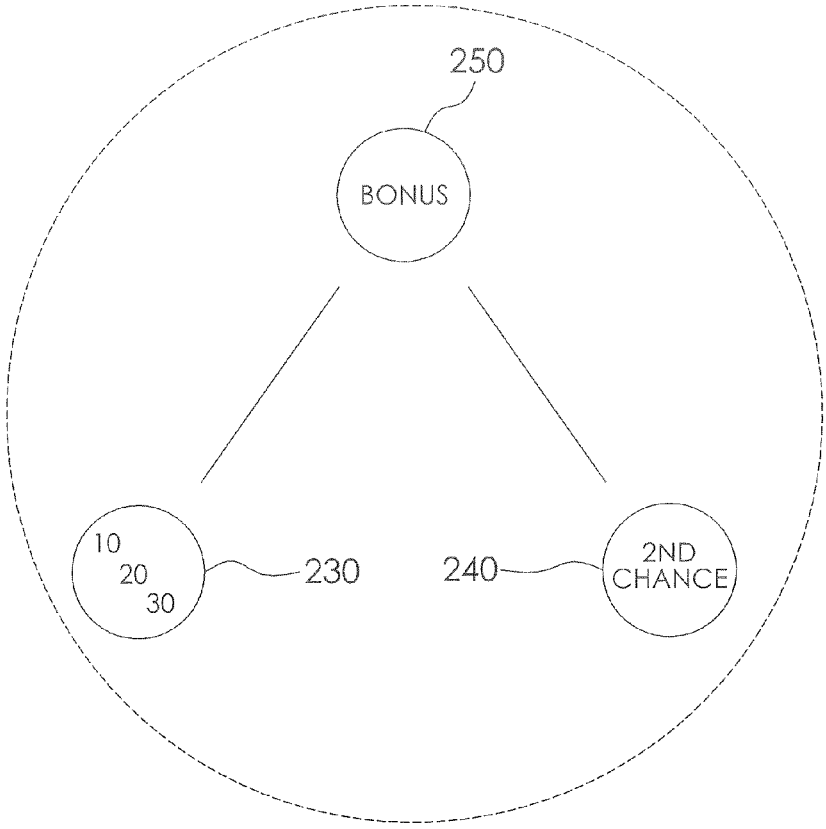
FIG. 3 is an enlarged view of the betting areas disposed on the table depicted in circle 3 of FIG. 2.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

The present invention is a fun and exciting table card game 10 played with at least one deck of playing cards. The table card game 10 may be played with a standard 52-card deck of cards, including four suits (hearts, diamonds, spades, and clubs), with each suit having numbered cards ranging from two (2) to ten (10), three face cards (Jack, Queen, and King), and an Ace card. In certain embodiments, a plurality of standard 52-card decks of cards may be employed. It should be understood that one or more non-standard decks of cards may also be employed, as desired.

The table card game 10 first includes the step of providing at least one player and a dealer. In particular embodiments, the table card game 10 includes a plurality of players. In a particularly illustrative embodiment, the table card game 10 includes up to about six players and a single dealer. The cards may be dealt to each player singularly or in groups or packets of a desired number. The dealer may be a professional dealer or a machine card dealer, for example. It should be further appreciated that the table card game 10 may be computer-based, with the cards depicted on a monitor and the dealer being part of a computer program, for example.

Figure 4:
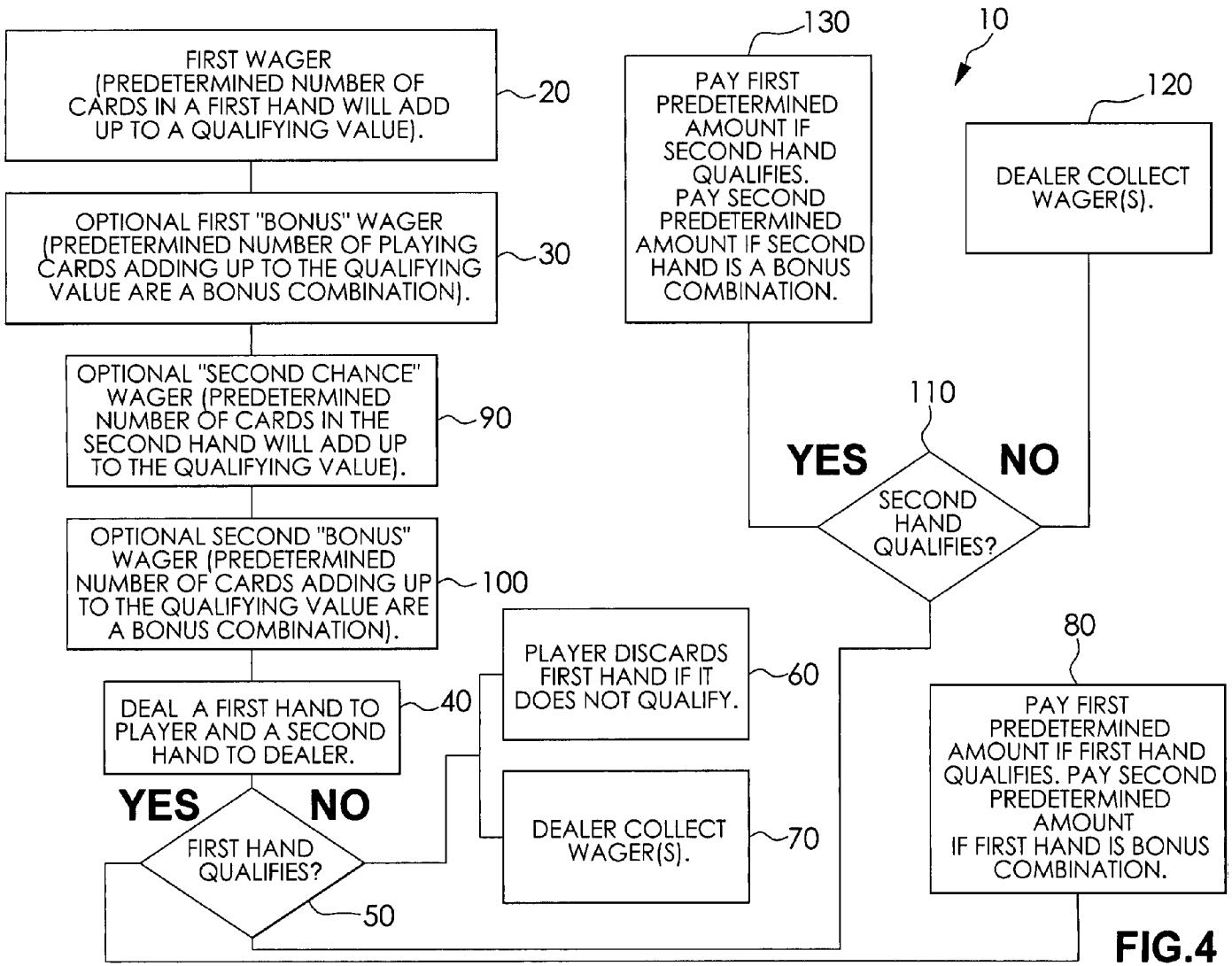
FIG. 4 is a flow diagram depicting a table card game according to the present disclosure.
Figure 5:
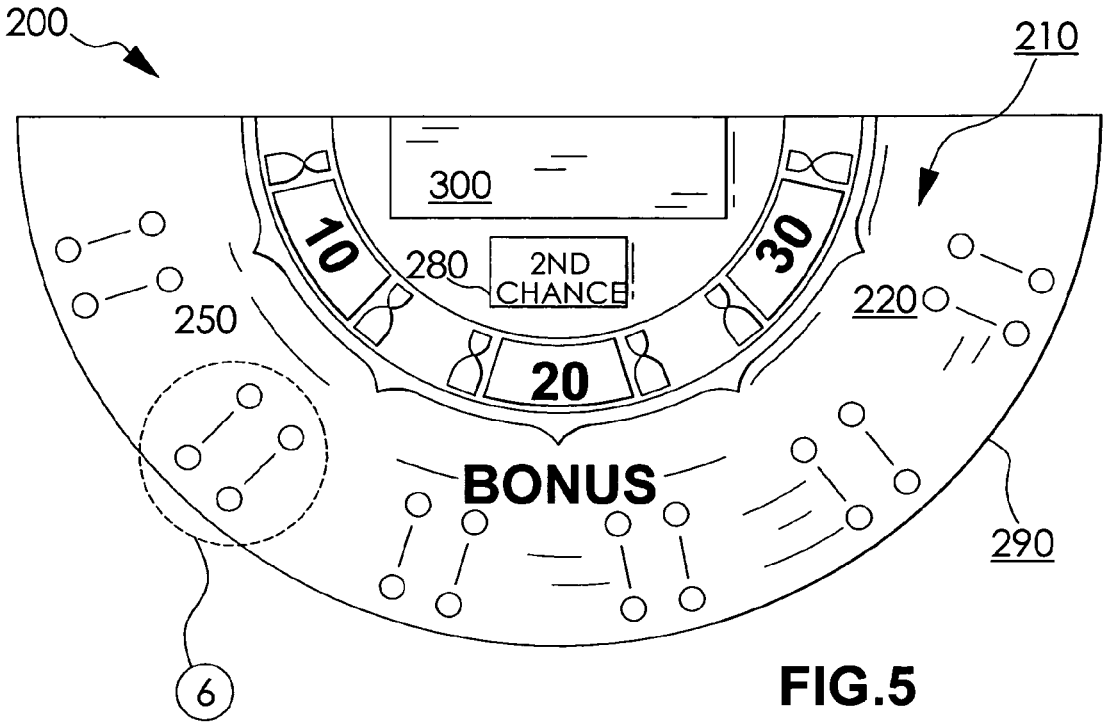
FIG. 5 is a top plan view of a table configured for use with the table card game depicted in FIGS. 1 and 4.
Figure 6:
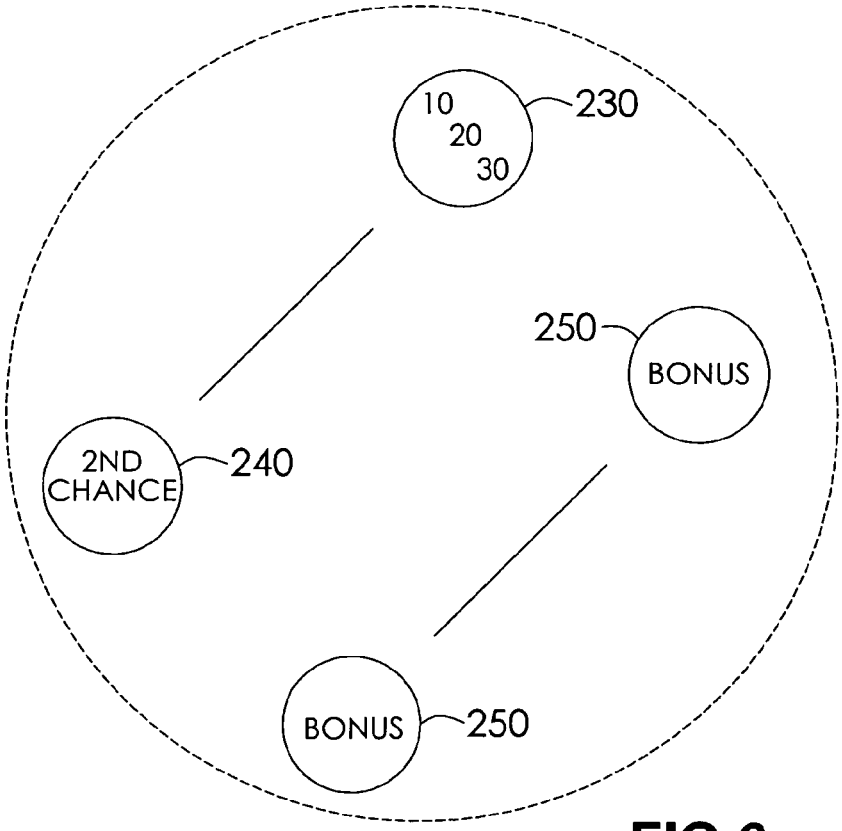
FIG. 6 is an enlarged view of the betting areas disposed on the table depicted in circle 6 of FIG. 5.

As shown in FIGS. 1 and 4, the table card game 10 includes a first step of allowing the player to make a first wager 20. The first wager 20 may be an optional wager or a mandatory wager, as desired. The first wager 20 is made as to whether a predetermined number of cards in a first hand to be dealt to the player from the deck of playing cards will add up to a qualifying value. The table card game 10 also includes a second step of allowing the player to optionally make a first bonus wager 30. The first bonus wager 30 is made as to whether the predetermined number of cards of the first hand dealt to the player, which will add up to the qualifying value, will also be a predetermined bonus combination.

Following the first wager 20 and the first optional bonus wagers 30, the dealer deals 40 the first hand to the player and a second chance hand to the dealer. The second chance hand is not a house hand and is not played by the dealer. Instead, the second chance hand is a community hand and is optionally played by all wagering players participating in the table card game 10. It should be appreciated that the dealer may be the facilitator of the second chance hand during the table card game 10. The player generally may not touch or look at the dealt cards until all cards are distributed and the dealer places the remaining cards in the discard rack, for example.

The player is allowed to examine the first hand and determine 50 whether the predetermined number of cards in the first hand will add up to the qualifying value. If the player determines that the predetermined number of cards in the first hand will not add up to the qualifying value, the player may discard 60 the first hand. If the player discards 60 the first hand, the dealer collects the player's first wager 20 and, if any, the optional first bonus wager 30.

If the player does determine 50 that the predetermined number of cards in the first hand will add up to the qualifying value, the first hand may be turned face up by the dealer working from the dealers right to left to reveal the cards. In certain embodiments, the player may discard at least one card of the first hand that exceeds the predetermined number of cards that will add up to the qualifying value, and thereby "set" the first hand. It should be appreciated that excess cards may be discarded to make it easier for the dealer to determine which cards the player believes add up to the qualifying value. All discards are collected by the dealer and may be locked up in a discard rack, for example. The dealer then determines 50 whether the predetermined number of cards in the first hand will add up to the qualifying value. If the dealer confirms that the predetermined number of cards will add up to the qualifying value, a payment 80 of a first predetermined amount and, if the first hand is a bonus combination, a second predetermined amount is made to the player.

Following the steps of collection 70 and payment 80 by the dealer, the table card game 10 of the present disclosure includes the opportunity for the player to make further, optional "second chance" wagers. The player is first allowed to optionally make a second chance wager 90. The second chance wager 90 is made as to whether the predetermined number of cards in the second chance hand dealt to the dealer from the deck of playing cards will add up to the qualifying value. The qualifying value for the second chance hand may be the same or different from the qualifying value of the first hand, as desired. The player is also allowed to optionally make a second chance bonus wager 100. The second chance bonus wager 100 is made as to whether the predetermined number of cards in the second chance hand dealt to the dealer that will add up to the qualifying value will also be the predetermined bonus combination. The player may make the optional second chance wager 90 and optional second chance bonus wager 100 regardless of whether the player has won or lost on the first wager and/or first bonus wager during previous play of the table card game 10.

If the player opts to make at least one of the second chance wager 90 and the second chance bonus wager 100, the second chance hand is turned face up. The dealer then determines 110 whether the predetermined number of cards in the second chance hand add up to the qualifying value. In certain embodiments, the dealer may discard the cards of the second chance hand that exceed the predetermined number of cards that add up to the qualifying value, and thereby "set" the second chance hand. If the predetermined number of cards in the second chance hand does not add up to the qualifying value, the dealer collects 120 the second chance wager 90 and, if any, the second chance bonus wager 100. If the predetermined number of cards in the second chance hand does add up to the qualifying value, a payment 130 of the first predetermined amount and, if the second chance hand is a bonus combination, the second predetermined amount is made to the player. The first and second predetermined amounts paid as a result of the optional second chance wager and optional second chance bonus wager may be the same or different from the first and second predetermined amounts paid as a result of the first wager and the first bonus wager, as desired.

The predetermined number of cards and the first hand and the second chance hand of cards may be any number of cards, as desired. As a nonlimiting example, the predetermined number of cards may be up to about four cards. In a most particular embodiment, the predetermined number of cards is three cards. Likewise, the first hand and the second chance hand of cards may be up to about five cards, and in a most particular embodiment are four cards. It should further be appreciated that the first hand and the second chance hand may contain different numbers of cards, as desired.

The qualifying value may be any value, as desired. Standard card values associated with the standard 52-card deck of cards may be employed. For example, the numbered card is considered to be a value equal to the respective number, the face card is considered to be a value of ten (10), and the ace card is considered to be a value of one (1). It should be appreciated that other values may also be employed. In further embodiments, a "wild card" may be selected to have a desired value other than the typically understood value for said card.

In a most particular embodiment, the qualifying value is a value equal to at least one of ten (10), twenty (20), and thirty (30). As one example, the predetermined number of cards consisting of 7, 2, and 1 or 4, 4 and 2 may each equal a qualifying value of ten (10). The predetermined number of cards consisting of 4, 4 and 2 would qualify as a bonus combination. In another example, the predetermined number of cards consisting of 8, 8 and 4 or 5, 9 and 6 may each equal the qualifying value of twenty (20). In a further example, the predetermined number of cards consisting of 10, Queen and King or King, Queen, and Jack may each equal the qualifying value of thirty (30).

In another embodiment according to the present disclosure, the qualifying value is a value equal to at least one of seven (7), fourteen (14), and twenty-one (21). One of ordinary skill in the art should understand that other qualifying values may be selected as desired.

It should be appreciated that the predetermined bonus combination may be any combination, as desired. In a most particular embodiment, the predetermined bonus combination is a poker hand. As nonlimiting examples, the predetermined bonus combination may include at least one of a pair, a flush, a straight, a three-of-a-kind, and a straight flush. In an embodiment where the qualifying value is a value equal to at least one of ten (10), twenty (20), and thirty (30), the predetermined number of cards consisting of 4, 4 and 2 and 8, 8 and 4 would each qualify as the bonus combination (pair). Likewise, the predetermined number of cards consisting of King, Queen, and Jack would qualify as the bonus combination (straight). Similarly, the bonus combination of the three-of-a-kind would be any three 10's, Jacks, Queens or Kings. Straight flushes would be any combination of 10, Jack, Queen or King in sequential order with the predetermined number of cards in the same suit.

A skilled artisan should understand that the payments 80, 130 of the first and second predetermined amounts may be based on any pay scale, as desired. In a particular embodiment, the payments 80, 130 of the first predetermined amounts may be a 1 to 1 pay scale based on the amount of the respective first wager 20 and optional second chance wager 90, for example. In another embodiment where the qualifying value is one of a ten (10), twenty (20), and thirty (30), the first predetermined amount may be based on a pay scale as follows:

| | |
|---|---|
| i) Ten (10) | 1 to 1 |
| ii) Twenty (20) | 2 to 1 |
| iii) Thirty (30) | 3 to 1 |

In a further embodiment where the qualifying value is one of a ten (10). twenty (20). and thirty (30). the first predetermined amount may be based on a pay scale as follows:

| | |
|---|---|
| i) Ten (10) | 4 to 1 |
| ii) Twenty (20) | 1 to 1 |
| iii) Thirty (30) | 2 to 1 |

In a most particular embodiment, the payments 80, 130 of the second predetermined amounts based on the amount of the respective optional first and second chance optional bonus wagers 30, 100 may be based on a pay scale as follows:

| | |
|---|---|
| i) Pair | 2 to 1 |
| ii) Flush | 5 to 1 |
| iii) Straight | 6 to 1 |
| iv) Three-of-a-kind | 30 to 1 |
| v) Straight flush | 40 to 1 |

In a further embodiment, the payments 80, 130 of the second predetermined amounts based on the amount of the respective optional first and second chance optional bonus wagers 20, 100 may be based on a pay scale as follows:

| | |
|---|---|
| i) 10, 20, 30 | Push |
| ii) Pair | 2 to 1 |
| iii) Flush | 4 to 1 |
| iv) Straight | 10 to 1 |
| v) Three-of-a-kind | 30 to 1 |
| vi) Straight flush | 40 to 1 |

Other pay scales for determining the payments 80, 130 of the second predetermined amounts may be employed as desired.

All discards are collected by the dealer and are locked up in the discard rack, for example. All wagers, discards and handsets are typically final. Table limits for wagers may also be selected as desired. Once the payments 80, 130, and collections 70, 120 are completed, the table card game 10 session is complete and a new table card game 10 may be started.

Referring now to FIGS. 2 to 3 and FIGS. 5 to 6, a casino table 200 for playing the table card game 10 includes a tabletop 210 with a substantially planar upper playing surface 220. The playing surface has a first betting area 230 for placement of the first wager 20 by the player, a second chance betting area 240 for placement of the optional second chance wager 90 by the player, and at least one bonus betting area 250 for placement of the optional bonus wager 30, 100 by the player. In a particular embodiment, a single bonus betting area 250 is employed for both the first wager 20 and the second chance wager 90. In another embodiment, a pair of bonus betting areas 250 are employed, one for each of the first wager 20 and the second chance wager 90.

In an alternative embodiment, the at least one bonus betting area 250 of the casino table 200 may further include a first bonus betting area for placement of the first bonus wager 30 during the making of the first wager 20. The at least one bonus betting area 250 may also include a second chance bonus betting area for placement of the second chance bonus wager 100 during the optional second chance wager 90.

The casino table 200 may further include a second chance area 280 for placing the second chance hand dealt to the dealer. The second chance area 280 is sufficiently large to contain and display the second chance hand dealt to the community. The second chance area 280 is generally disposed adjacent an end of the table where the dealer is located.

It should be appreciated that the casino table 200 may have the general dimensions associated with a standard casino table, such as a standard Blackjack table as is known in the art. For example, the tabletop 210 may have a curvilinear edge 290 adjacent which the player may sit. The curvilinear edge 290 may have a length sufficient for at least six players to sit adjacent, for example. In a particular example, the tabletop 210 has a length of about 72 inches and a width of about 36 inches. Other suitable dimensions may also be selected as desired.

In a further embodiment, the tabletop 210 may have a chip holder 300 formed therein for containing chips for paying the player in the table card game 10.

It should be appreciated that the player of the table card game 10 has four ways of winning, for example, by offering the first wager 20, the optional second chance wager 90, and the two optional bonus wagers 30, 100. The player typically makes the first wager 20 prior to the first hand being dealt to the player, although the making of the first wager 20 may occur after the first hand is dealt to the player, as desired.

In the most particular example, the qualifying value is one of the ten (10), the twenty (20), and the thirty (30), the predetermined number of cards is three cards, and the first hand and the second chance hand consist of four cards apiece. The object of the table card game 10 in said example is for the player to identify the three cards from the four cards dealt to the player that equals the 10, 20 or 30 point value. A further object is for the player to identify any bonus combination of the dealt cards that qualifies for the "bonus" wager when playing either of the two optional bonus wagers 30, 100.

The present table card game 10 is uncomplicated and exciting. The table card game 10 also advantageously provides the opportunity for the player to make multiple wagers and choices regarding those wagers.

While certain representative embodiments and details have been shown for purposes of illustrating the invention, it will be apparent to those skilled in the art that various changes may be made without departing from the scope of the disclosure, which is further described in the following appended claims.

What is claimed is:

1. A method of playing a table card game using a deck of playing cards, the method comprising the steps of:

a) providing the deck of cards as either a physical deck of cards or as a deck of cards depicted on a monitor;

b) allowing a player to make an optional first wager as to whether a predetermined number of cards in a first hand to be dealt to the player from the deck of playing cards will add up to a qualifying value;

c) allowing the player to optionally make a first bonus wager as to whether the predetermined number of cards of the first hand dealt to the player that will add up to the qualifying value will also be a predetermined bonus combination;

d) allowing the player to optionally make a second chance wager as to whether the predetermined number of cards in a second chance hand dealt from the deck of playing cards will add up to the qualifying value;

e) allowing the player to optionally make a second chance bonus wager as to whether the predetermined number of cards in the second chance hand that will add up to the qualifying value will also be the predetermined bonus combination;

f) dealing the first hand to the player and the second chance hand as a community hand;

g) determining whether a predetermined number of cards in the first hand add up to the qualifying value;

h) paying the player a first predetermined amount based on the amount of the player's first wager if the predetermined number of cards in the first hand add up to the qualifying value, and paying the player a second predetermined amount based on the amount of the player's optional bonus wager, if any, if the predetermined number of cards that add up to the qualifying value are the predetermined bonus combination;

i) collecting the player's first wager if the predetermined number of cards in the first hand do not add up to the qualifying value, and collecting the player's optional first bonus wager, if any, if the predetermined number of cards in the first hand that add up to the qualifying value are not the predetermined bonus combination;

j) determining whether a predetermined number of cards in the second chance hand add up to the qualifying value;

k) paying the player the first predetermined amount based on the amount of the player's second chance wager if the predetermined number of cards in the second chance hand add up to the qualifying value, and paying the player the second predetermined amount based on the amount of the player's optional second chance bonus wager, if any, if the predetermined number of cards in the second chance hand that add up to the qualifying value are the predetermined bonus combination; and l) collecting the player's second chance wager and optional second chance bonus wager, if any, if the predetermined number of cards in the second chance hand do not add up to the qualifying value.

2. The method of claim 1, wherein the deck of playing cards includes at least one standard fifty-two card deck.

3. The method of claim 1, wherein the predetermined number of cards is three cards and at least one of the first hand and the second chance hand is four cards.

4. The method of claim 1, wherein the qualifying value is a value equal to at least one of ten (10), twenty (20), and thirty (30).

5. The method of claim 4, wherein the first predetermined amount is based on a pay scale as follows:

| | |
|---|---|
| i) Ten (10) | 1 to 1 |
| ii) Twenty (20) | 2 to 1 |
| iii) Thirty (30) | 3 to 1. |

6. The method of claim 1, wherein a numbered card is considered to be a value equal to the respective number of the numbered card, a face card is considered to be a value of ten (10), and an Ace card is considered to be a value of one (1).

7. The method of claim 1, wherein the first predetermined amount is based on a 1 to 1 pay scale.

8. The method of claim 1, wherein the predetermined bonus combination is a poker hand.

9. The method of claim 8, wherein the predetermined bonus combination includes at least one of a pair, a flush, a straight, a three-of-a-kind, and a straight flush.

10. The method of claim 9, wherein the second predetermined amount is based on a pay scale as follows:

| | |
|---|---|
| i) Pair | 2 to 1 |
| ii) Flush | 5 to 1 |
| iii) Straight | 6 to 1 |
| iv) Three-of-a-kind | 30 to 1 |
| v) Straight flush | 40 to 1. |

11. The method of claim 1, further comprising the step of providing the player and a dealer, wherein the dealer is one of a professional dealer and a mechanical card dealer.

12. The method of claim 1, wherein the table card game is computer-based.

13. A method of playing a table card game using a deck of playing cards, the method comprising the steps of:

a) providing the deck of cards as either a physical deck of cards or as a deck of cards depicted on a monitor;

b) providing a player and a dealer;

c) allowing the player to make a mandatory first wager as to whether three cards in a first hand of four cards to be dealt to the player from the deck of playing cards will add up to a qualifying value often (10), twenty (20), or thirty (30);

d) allowing the player to optionally make a first bonus wager as to whether three cards of the first hand dealt to the player that will add up to the qualifying value will also be one of a pair, a flush, a straight, a three-of-a-kind, and a straight flush;

e) allowing the player to optionally make a second chance wager as to whether three of the cards in a second chance hand dealt to the dealer will add up to the qualifying value often (10), twenty (20), or thirty (30);

f) allowing the player to optionally make a second chance bonus wager as to whether three of the cards in the second chance hand dealt to the dealer that will add up to the qualifying value of ten (10), twenty (20), or thirty (30) will also be one of the pair, the flush, the straight, the three-of-a-kind, and the straight flush;

g) dealing the first hand face down to the player and the second chance hand face down to the dealer;

h) allowing the player to examine the first hand;

i) allowing the player to discard the first hand if the player determines that three of the cards in the first hand will not add up to the qualifying value of ten (10), twenty (20), or thirty (30);

j) collecting the player's first wager and, if any, the optional first bonus wager if the player discards the first hand;

k) turning face up the first hand dealt to the player if the player does not discard the first hand;

l) determining whether the three cards in the first hand add up to the qualifying value of ten (10), twenty (20), or thirty (30);

m) paying the player a first predetermined amount at a 1 to 1 pay scale based on the amount of the player's first wager if three of cards in the first hand add up to the qualifying value often (10), twenty (20), or thirty (30);

n) paying the player a second predetermined amount at a pay scale as follows

| | |
|---|---|
| i) Pair | 2 to 1 |
| ii) Flush | 5 to 1 |
| iii) Straight | 6 to 1 |
| iv) Three-of-a-kind | 30 to 1 |
| v) Straight flush | 40 to 1 |

based on the amount of the player's optional bonus wager, if any, if three of the cards that add up to the qualifying value of ten (10), twenty (20), or thirty (30) are one of the pair, the flush, the straight, the three-of-a-kind, and the straight flush;

o) collecting the player's first wager if three of cards in the first hand do not add up to the qualifying value of ten (10), twenty (20), or thirty (30);

p) collecting the player's optional first bonus wager, if any, if three of the cards in the first hand that add up to the qualifying value are not one of the pair, the flush, the straight, the three-of-a-kind, and the straight flush;

q) turning face up the second chance hand dealt to the dealer;

r) determining whether three of the cards in the second chance hand add up to the qualifying value of ten (10), twenty (20), or thirty (30);

s) paying the player the first predetermined amount at a 1 to 1 pay scale based on the amount of the player's second chance wager if the predetermined number of cards in the second chance hand add up to the qualifying value;

t) paying the player the second predetermined amount at a pay scale as follows

| | |
|---|---|
| i) Pair | 2 to 1 |
| ii) Flush | 5 to 1 |
| iii) Straight | 6 to 1 |
| iv) Three-of-a-kind | 30 to 1 |
| v) Straight flush | 40 to 1 |

based on the amount of the player's optional second chance bonus wager, if any, if three of the cards in the second chance hand that add up to the qualifying value are one of the pair, the flush, the straight, the three-of-a-kind, and the straight flush; and u) collecting the player's second chance wager and optional second chance bonus wager, if any, if three of the cards in the second chance hand do not add up to the qualifying value of ten (10), twenty (20), or thirty (30).

* * * * *